US006140032A

United States Patent [19]

Ikesu et al.

[11] Patent Number: 6,140,032

[45] Date of Patent: Oct. 31, 2000

[54] SILVER HALIDE COLOR PHOTOGRAPHIC LIGHT-SENSITIVE MATERIAL CONTAINING A NOVEL YELLOW COUPLER

[75] Inventors: Satoru Ikesu; Katsuji Ota; Kazuhiko Kimura, all of Hino, Japan

[73] Assignee: Konica Corporation, Japan

[21] Appl. No.: 09/196,063

[22] Filed: Nov. 19, 1998

[30] Foreign Application Priority Data

Nov. 25, 1997 [JP] Japan ..... 9-322989

[51] Int. Cl.[7] ..... G03C 1/08

[52] U.S. Cl. ..... 430/557; 430/543; 430/556

[58] Field of Search ..... 430/556, 557, 430/543

[56] References Cited

U.S. PATENT DOCUMENTS

| | | | |
|---|---|---|---|
| 1,035,988 | 7/1912 | Nakamura et al. | 430/505 |
| 5,451,492 | 9/1995 | Merkel et al. | 430/557 |
| 5,719,018 | 2/1998 | Katsumata et al. | 430/557 |
| 5,928,850 | 7/1999 | Murai et al. | 430/557 |

*Primary Examiner*—Geraldine Letscher
*Attorney, Agent, or Firm*—Jordan B. Bierman; Bierman, Muserlian and Lucas

[57] ABSTRACT

A silver halide color photographic light-sensitive material characterized in that the light-sensitive material contains a yellow coupler represented by the following Formula [I];

Formula [I]

wherein $R_1$ represents an alkyl group, a cycloalkyl group, an amino group, a heterocyclic group or an aryl group, $R^2$ represents a straight chain or branched unsubstituted alkyl group having not less than 2 carbon atoms, X represents a chlorine atom, an alkoxy group or aryloxy group. Y represents an acylamino group or a chlorine atom when $R_1$ represents an alkyl group, a cycloalkyl group, an amino group or a heterocyclic group , and Y represents an sulfonylamino group, a chlorine atom or oxycarbonyl group when $R_1$ represents an aryl group. n represents an integer of 0 to 4. When n is not less than 2, plural Y may be either the same or different.

22 Claims, No Drawings

SILVER HALIDE COLOR PHOTOGRAPHIC LIGHT-SENSITIVE MATERIAL CONTAINING A NOVEL YELLOW COUPLER

FIELD OF THE INVENTION

This invention relates to a silver halide color photographic light-sensitive material, particularly relates to a color light-sensitive material containing a novel yellow coupler which is excellent in color-forming efficiency, excellent in solubility in low boiling solvent and excellent in dispersion stability.

BACKGROUND OF THE INVENTION

In recent years in silver halide photographic light-sensitive material (hereinafter referred to as color light-sensitive material), in place of 4-equivalent coupler by which reduction of 4 silver atoms are necessary to form one molecule of dye, 2-equivalent coupler has been mostly used, in which an appropriate substituent is introduced at the coupling position or reactive position at which the coupler is reacted with the oxidation product of a color developing agent so that one molecular of dye can be formed from the coupler by the reduction of two silver atoms.

For examples of the substituents introduced at the coupling position employed in yellow coupler are cited aryloxy group described in Japanese Patent Publication Open to Public Inspection (JP O.P.I.) NO. 50-87650/1975 and U.S. Pat. No. 3,408,194, oxazolyloxy group described in JP O.P.I. No. 51- 131325/1976, chroman-4-oxy group described in JP O.P.I. No. 51-139333/1976, tetrazolyloxy group described in JP O.P.I. No. 52-43420/1977, pyrazolyloxy group described in JP O.P.I. No. 52-150631/1977, nitrogen containing heterocyclic group described in JP O.P.I. No. 52-115219/1977, urazole group described in an examined Patent Publication No. 51-33410/1976, hydaintoin group described in an examined Patent Publication No. 51-10783/1976, pyrazolyloxy group described in JP O.P.I. No. 52-150631/1977, oxazolidinedione group described in JP O.P.I. No. 48-66835/1973 and arylthio group described in U.S. Pat. No. 3,227,554. Among them, a few coupling-off groups have been already practically used, especially the oxazolidinedione group described in JP O.P.I. No. 48-66835/1973 is an excellent coupling-off group resulting in efficient color forming.

Requirements to the coupler are increasingly made harder accompanied with a progress in the color light-sensitive material and with respect to 2-equivalent yellow coupler, more improvement in the color-forming efficiency is required.

The 2-equivalent yellow coupler possessing the oxazolidinedione group as a coupling-off group at the coupling position has an advantage mentioned above, however, because of insufficient solubility of this type of coupler in a low boiling solvent such as ethylacetate, in order to disperse the coupler in the solvent, a large amount of solvent is needed. This disadvantage causes a inconvenient problem in manufacturing the color light-sensitive material. Furthermore this type of coupler tends to crystallize after once dispersed in the solvent and is inferior in dispersing stability. To overcome this drawbacks is strongly required.

SUMMARY OF THE INVENTION

The present invention is made to solve the above- mentioned problems. The first object of the invention is to provide a color light-sensitive material which contains a novel 2-equivalent yellow coupler which is excellent in the color-forming efficiency. The second object of the invention is to provide a color light-sensitive material containing a novel 2-equivalent coupler of which solubility in the low boiling solvent is high enough to show an excellent dispersion stability.

DETAILED DESCRIPTION OF THE INVENTION

The above-mentioned objects of the invention can be attained by the following method.

(1) A silver halide color photographic light-sensitive material comprising a support having thereon a silver halide emulsion layer containing silver halide grains, wherein said silver halide emulsion layer contains a yellow coupler represented by the following Formula [I];

Formula [I]

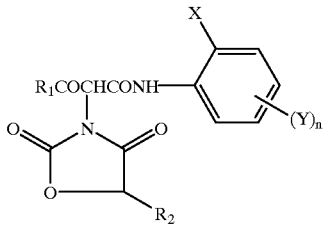

wherein $R_1$ represents an alkyl group, a cycloalkyl group, an amino group, a heterocyclic group or an aryl group, $R_2$ represents a straight chain or branched unsubstituted alkyl group having not less than 2 carbon atoms; X represents a chlorine atom, an alkoxy group or aryloxy group; Y represents an acylamino group or a chlorine atom when $R_1$ represents an alkyl group, a cycloalkyl group, an amino group or a heterocyclic group; and Y represents an sulfonylamino group, a chlorine atom or oxycarbonyl group when $R_1$ represents an aryl group; n represents an integer of 0 to 4; when n is not less than 2, plural Y may be either the same or different.

(2) The silver halide color photographic light-sensitive material of claim 1, wherein $R_1$ represents an alkyl group, a cycloalkyl group, an amino group, or a heterocyclic group in said formula [I].

(3) The silver halide color photographic light-sensitive material of claim 1, wherein $R_1$ represents an aryl group in said formula [I].

Next, the invention will be explained in detail. First, the yellow coupler represented by the above formula [I] will be explained in detail.

In the formula [I], as the alkyl group represented by $R_1$ is cited a methyl group, an ethyl group, an i-propyl group, a t-butyl group and a dodecyl group. These alkyl groups may be substituted by a halogen atom, an aryl group, an alkoxy group, an aryloxy group, an alkylsulfonyl group, an acyl amino group and hydroxyl group.

As the cycloalkyl group represented by $R_1$ is cited a cyclopropyl group, a cyclohexyl group or an adamantyl group.

As the amino group represented by $R_1$ is cited a diethylamino group, a di-i-octylamino group and an anilino group. These amino groups may be substituted by the similar substituents which are cited as the above mentioned substituents for the alkyl group represented by $R_1$.

As the heterocyclic group represented by $R_1$ is cited a morpholino group and an indoline-1-yl group. As an aryl group represented by $R_1$, is cited a phenyl group and a naphthyl group. These aryl groups may be substituted by the similar substituents which are cited as the above mentioned substituents for the alkyl group represented by $R_1$.

Preferred $R_1$ is an alkyl group, a cycloalkyl group, an amino group and heterocyclic group, more preferred is an alkyl group, especially preferred is a t-butyl group.

As the straight chain or branched unsubstituted alkyl group having not less than 2 carbon atoms represented by $R_2$, is cited an ethyl group, a propyl group, an i-propyl group, a butyl group and a hexyl group.

As a substituent group $R_2$, the straight chain unsubstituted alkyl group is preferable, more preferable is the straight chain unsubstituted alkyl group having not less than 4 carbon atoms.

As the alkoxy group represented by X is cited a methoxy group, an ethoxy group, an i-propoxy group, a butoxy group, a decyloxy group and a dodecyloxy group. As the aryloxy group, a phenoxy group is representative.

AS the acylamino group represented by Y is cited a palmitoylamino group, a stearoylamino group and a 2-(2,4-di-t-pentylphenoxy)butanoylamino group. As the sulfonylamino group represented by Y is cited a dodecylsulfonylamino group and 4-dodecyloxybenzenesulfonylamino group. As the oxycarbonyl group represented by Y is cited a dodecyloxycarbonyl group and hexadecyloxycarbonyl group.

In the formula [I], any one of $R_1$, X and Y is nondiffusible group (ballast group), and the sum total of the carbon atoms of $R_1$, X and Y is preferably not less than 12.

Examples of the 2-equivalent yellow coupler represented by Formula [I] are shown below, but are not limited thereto.

(1)

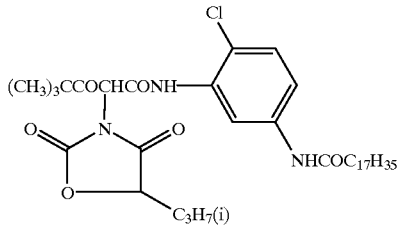

(2)

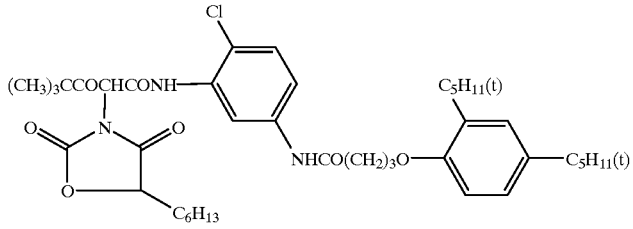

(3)

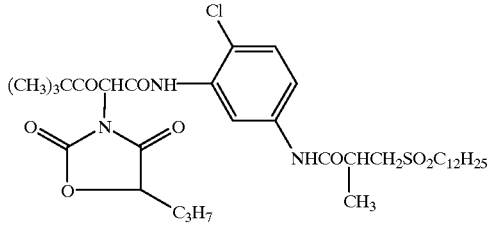

(4)

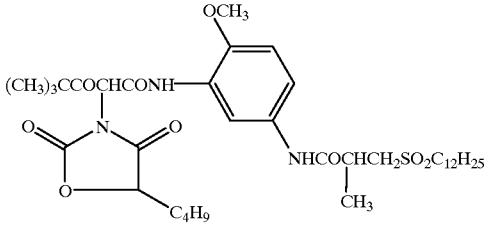

(5)

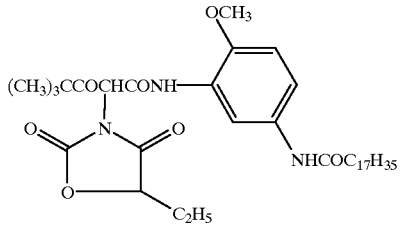

-continued
(6)
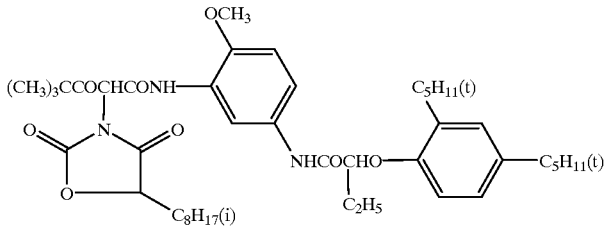
(7)
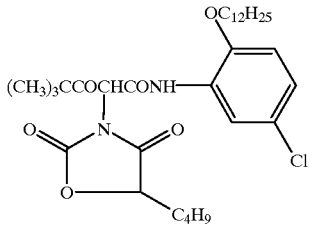
(8)
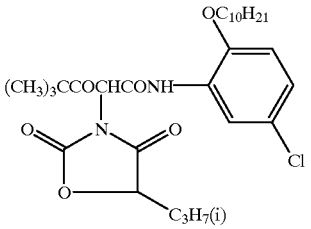
(9)
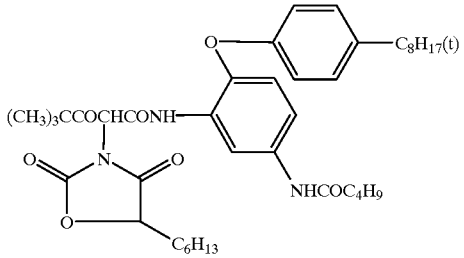
(10)
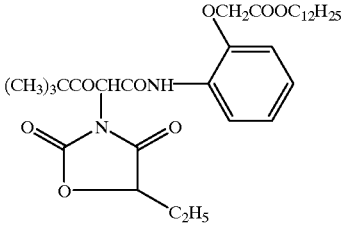
(11)
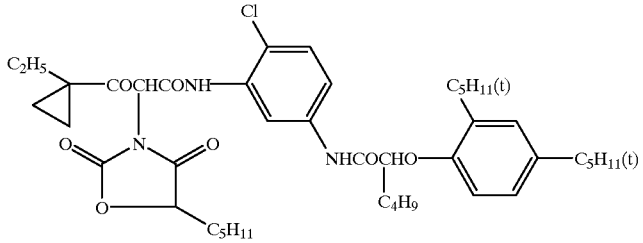
(12)
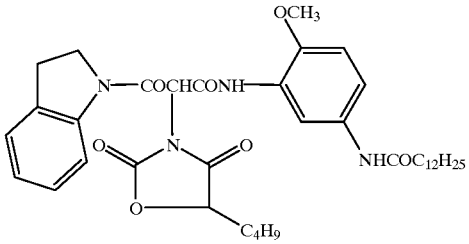
(13)
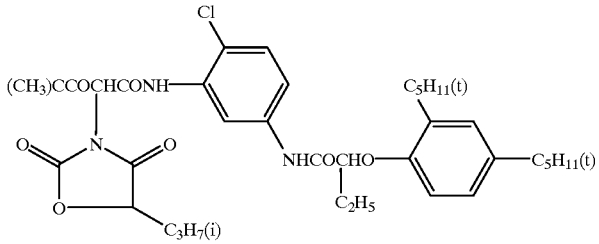

-continued
(14)
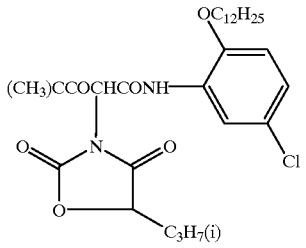
(15)
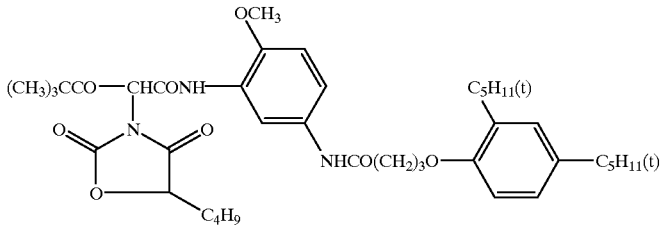
(16)
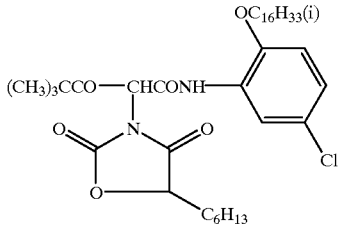
(17)
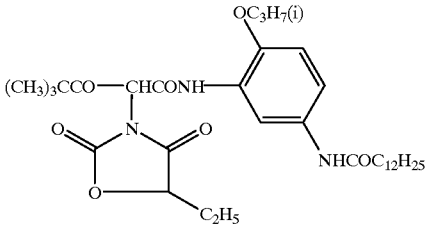
(18)
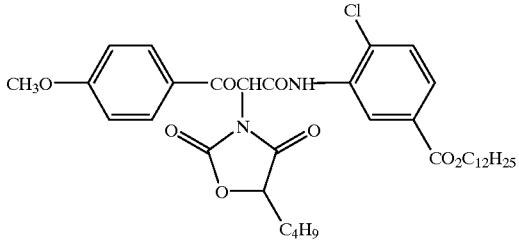
(19)
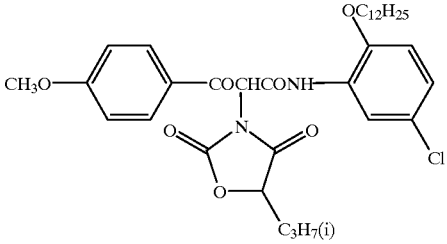
(20)
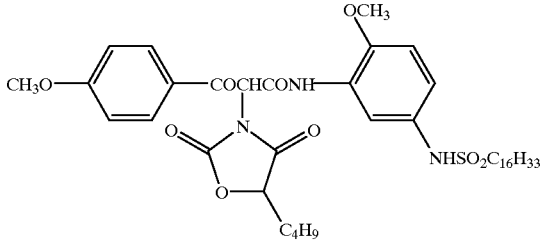
(21)
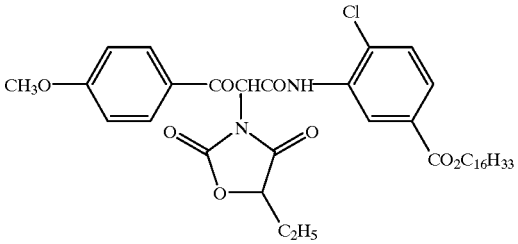
(22)
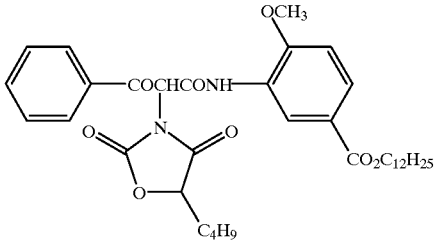

The yellow coupler represented by Formula [I] of the invention can be easily synthesized by a known method. A typical synthesizing method is shown below. Synthesis Example Exemplified Compound 7 was synthesized according to the following scheme.

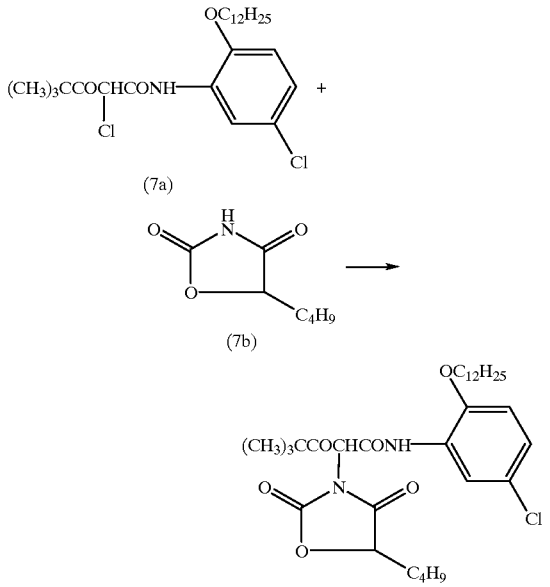

(Exemplified Compound 7)

In 360 ml of acetone, 120 g (0.254 moles) of (7a), 51.9 g (0.330 moles) of (7b) and 45.6 g (0.330 moles) of potassium carbonate were reacted for 5 hours under heat reflux. After reaction, acetone was recovered by evaporation under a reduced pressure. Ethylacetate and water was added to the residue and organic components were extracted by ethylacetate. The organic layer was separated, washed by aqueous sodium carbonate solution twice, by diluted hydrochloric acid once, and then by water three times. After then, ethylacetate was recovered by evaporation under a reduced pressure and the residue was crystallized from 300 ml of methanol. Thus 127 g of the Exemplified Compound 7 was obtained (a yield of 84%). Melting point is 83 to 86° C.

The chemical structure of thus obtained Exemplified Compound 7 is confirmed by NMR, IR and mass-spectrum thereof.

Exemplified couplers other than Exemplified Compound 7 were synthesized by a method similar to the above-mentioned method using a raw material corresponding to each of the couplers.

The coupler of the invention can be used solely or in combination of two or more kinds thereof. The coupler can be used with a known pivaloylacetoanilide type or benzoylacetoanilide type yellow coupler in combination without any limitation.

The yellow coupler of the invention can be added to a silver halide photographic emulsion, for example, by the following method. The yellow coupler is dissolved in one or more kind of organic solvent selected from high-boiling organic solvents each having a boiling point of not less than 175° C. such as tricresyl phosphate or dibutyl phthalate and a low-boiling organic solvent usually used for preparing a coupler dispersion such as ethyl acetate, methanol, acetone, chloroform, methyl chloride or butyl propionate. The solution is mixed with a gelatin solution containing a surfactant, and is dispersed by a high-speed rotating mixer or a colloid mill. Thus obtained dispersion is added to the emulsion directly or after removing the low-boiling solvent by setting, cutting and washing by water.

It is preferred that the yellow coupler is added in an amount of $1\times10^{-3}$ moles to 1 mole per mole of silver halide. The amount of the yellow coupler can be varied without the above-mentioned range according to the purpose of the use.

The silver halide color photographic light-sensitive material of the invention includes any kind ones having any purpose. As the silver halide, for example, silver chloride, silver bromide, silver iodide, silver chlorobromide, silver iodobromide and silver chloroiodobromide can be used.

In the color light-sensitive material of the invention, another coupler can be contained together with the yellow coupler according to the invention to form a multi-color image.

In the color light-sensitive material of the invention, various kinds of additives such as a color fog preventing agent, an image stabilizing agent, a hardener, a plasticizer, a polymer latex, a formalin scavenger, a mordant, a development accelerator, a development delaying agent, a fluorescent whitening agent, a matting agent, a solvent, an antistatic agent and a surfactant can be optionally used.

Further, by adding ultraviolet radiation absorbers to the color light-sensitive material containing the yellow coupler of the invention, the stability of the yellow dye derived from the yellow coupler of the invention can be still more improved.

EXAMPLES

The invention is described below referring examples, an embodiment of the invention is not limited thereto.

Example 1

A paper support was prepared which was laminated with a polyethylene layer on a surface and a titanium oxide-containing polyethylene layer on another surface. Sample 101 of multi-layered silver halide color photographic light-sensitive material was prepared by coating the layers each having the following constitution on the titanium oxide-containing polyethylene layer laminated surface of the support. Coating liquids of each layers were prepared as follows.

Dispersion solution of yellow coupler

To 26.7 g of yellow coupler (Y-1), 10.0 g of dye image stabilizing agent (ST-1), 6.67 g of dye image stabilizing agent (ST-2), 0.67 g of color-mixing preventing agent (HQ-1), 0.34 g of antihalation dye (AI-3) and 0.67 g of high-boiling solvent (DNP), 60 ml of ethyl acetate was added to dissolve the above-mentioned ingredients. Thus obtained solution was dispersed in 220 ml of a 10% gelatin solution containing 7 ml of 20% solution of surfactant (SU-1) by an ultrasonic homogenizer to prepare a yellow coupler dispersion (A).

The turbidity of the yellow coupler dispersion (A) was measured by Poick integrating sphere type turbidimeter (produced by Nihon Seimitsu Kougaku Co., Ltd). On the other hand, the yellow coupler dispersion (B) was prepared by preserving the yellow coupler dispersion (A) at 40° C. for 24 hours, and the turbidity of the yellow coupler dispersion (B) was also measured. The results were listed in Table 1.

Coating liquid of first layer

A coating liquid of the first layer was prepared by mixing the yellow coupler dispersion (A) and a blue-sensitive silver halide emulsion (containing 8.68 g of silver) according to the later-mentioned condition.

Coating liquids of the second to seventh layers were each prepared by a method similar to that of the first layer coating liquid.

Hardeners (H-1) was added to the second and fourth layers and hardener (H-2) was added to the seventh layer. Surfactants (SU-2) and (SU-3) were added as coating aids to control the surface tension of the coating liquid.

The constitutions of the layers are listed below in which the amount is described in g/m$^2$ and the amount of the emulsion is described in terms of silver.

| | Coating amount |
|---|---|
| Seventh layer: Protective layer | |
| Gelatin | 1.0 |
| Silica (average particle size: 3 μm) | 0.03 |
| Color-mixing preventing agent (HQ-2) | 0.002 |
| Color-mixing preventing agent (HQ-3) | 0.002 |
| Color-mixing preventing agent (HQ-4) | 0.004 |
| Color-mixing preventing agent (HQ-5) | 0.02 |
| DIDP | 0.005 |
| Compound (DI-1) | 0.002 |
| Sixth layer: Interlayer | |
| Gelatin | 0.4 |
| UV absorbent (UV-1) | 0.1 |
| UV absorbent (UV-2) | 0.04 |
| UV absorbent (UV-3) | 0.16 |
| Color-mixing preventing agent (HQ-5) | 0.04 |
| DNP | 0.2 |
| PVP | 0.03 |
| Anti-irradiation dye (AI-2) | 0.02 |
| Anti-irradiation dye (AI-4) | 0.01 |
| Fifth layer: Red-sensitive layer | |
| Gelatin | 1.3 |
| Red-sensitive silver chlorobromide emulsion spectrally sensitized by sensitizing dye (RS-1) (AgBr: 5 mole-%, AgCl: 95 mole-%) | 0.21 |
| Cyan coupler (C-1) | 0.17 |
| Cyan coupler (C-2) | 0.25 |
| Color-mixing preventing agent (HQ-1) | 0.02 |
| HBS-1 | 0.2 |
| DOP | 0.2 |
| Anti-irradiation dye (AI-1) | 0.01 |
| Fourth layer: Interlayer | |
| Gelatin | 0.94 |
| UV absorbent (UV-1) | 0.28 |
| UV absorbent (UV-2) | 0.09 |
| UV absorbent (UV-3) | 0.38 |
| Color-mixing preventing agent (HQ-5) | 0.10 |
| DNP | 0.4 |
| Third layer: Green-sensitive layer | |
| Gelatin | 1.2 |
| Green-sensitive silver chlorobromide emulsion spectrally sensitized by sensitizing dye (GS-1) (AgBr: 5 mole-%, AgCl: 95 mole-%) | 0.35 |
| Magenta coupler (M-1) | 0.23 |
| Color image stabilizing agent (ST-3) | 0.20 |
| Color image stabilizing agent (ST-4) | 0.17 |
| DIDP | 0.13 |
| DBP | 0.13 |
| Anti-irradiation dye (AI-3) | 0.01 |
| Second layer: Interlayer | |
| Gelatin | 1.2 |
| Color-mixing preventing agent (HQ-2) | 0.03 |
| Color-mixing preventing agent (HQ-3) | 0.03 |

-continued

| | Coating amount |
|---|---|
| Color-mixing preventing agent (HQ-4) | 0.05 |
| Color-mixing preventing agent (HQ-5) | 0.23 |
| DIDP | 0.13 |
| Compound (F-1) | 0.002 |
| First layer: Blue-sensitive layer | |
| Gelatin | 1.2 |
| Blue-sensitive silver chlorobromide emulsion spectrally sensitized by sensitizing dye (BS-1) (AgBr: 5 mole-%, AgCl: 95 mole-%) | 0.26 |
| Yellow coupler (Y-1) | 0.80 |
| Color image stabilizing agent (ST-1) | 0.30 |
| Color image stabilizing agent (ST-2) | 0.20 |
| Color-mixing preventing agent (HQ-1) | 0.02 |
| Anti-irradiation dye (AI-3) | 0.01 |
| DNP | 0.02 |
| Backing layer | |
| Gelatin | 6.0 |
| Silica (average particle size: 3 μm) | 0.1 |

The silver halide emulsions used in the above-mentioned emulsion layers are each a monodisperse cubic grain emulsion having a size distribution width of not more than 10%. The emulsions are each subjected to optimal chemical sensitization in the presence of sodium thiosulfate, chloroauric acid, and ammonium thiocyanate, and the optical sensitizing dye and stabilizers, STAB-1 and STAB-2 were added to the emulsion.

Chemical structures of the compounds used in the sample are shown below.

PVP: Polyvinylpyrrolidone

DBP: Dibutyl phthalate

DOP: Dioctyl phthalate

DNP: Dinonyl phthalate

DIDP: Diisodecyl phthalate

HQ-1: 2,5-di-t-octylhydroquinone

HQ-2: 2,5-di-s-dodecylhydroquinone

HQ-3: 2,5-di-s-tetradecylhydroquinone

HQ-4: 2-s-dodecyl-5-s-tetradecylhydroquinone

HQ-5: 2,5-bis(1,1-dimethyl-4-hexyloxycarbonylbutyl) hydroquinone

SU-1: Sodium i-propylnaphthalenesulfonate

SU-2: Sodium di(ethylhexyl)sulfosuccinate

SU-3: Sodium di(2.2.3.3.4.4.5.5-octafluoropentyl) sulfosuccinate

STAB-1: 4-hydroxy-6-methyl-1,3,3a,7-tetraazaindene

STAB-2: 1-(3-acetoamido)phenyl-5-mercaptotetrazole

H-1: $O(CH_2SO_2CH{=}CH_2)_2$

H-2: Sodium salt of 2,4-dichloro-6-hydroxy-s-triazine

M-1
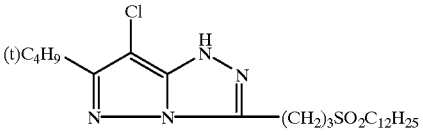
C-1
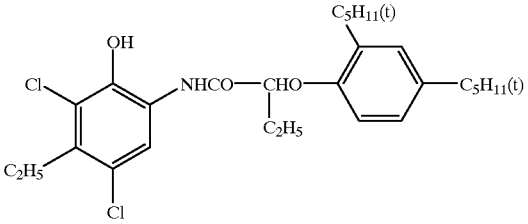
C-2
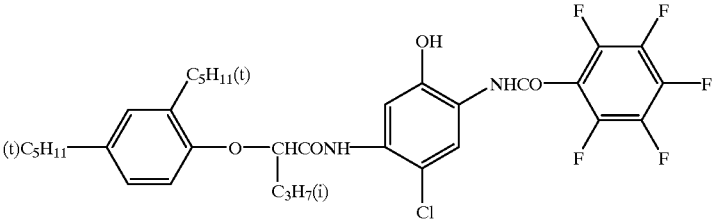
ST-1
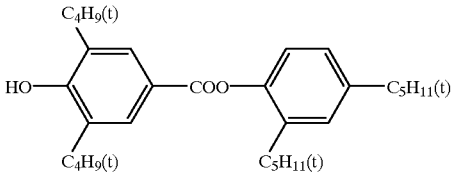
ST-2
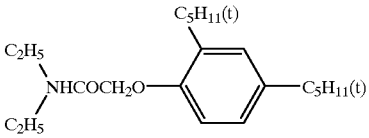
ST-3
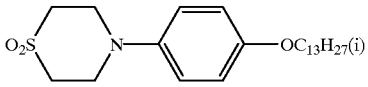
ST-4
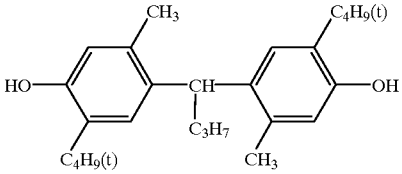
UV-1
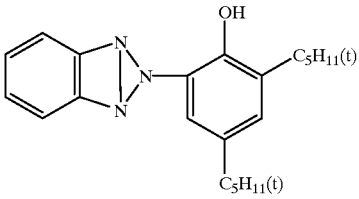
UV-2
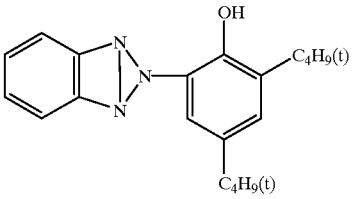
UV-3
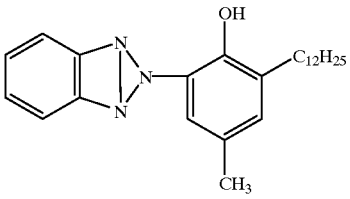
HBS-1
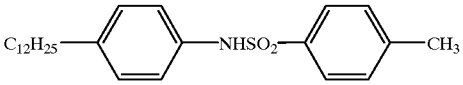
AI-1
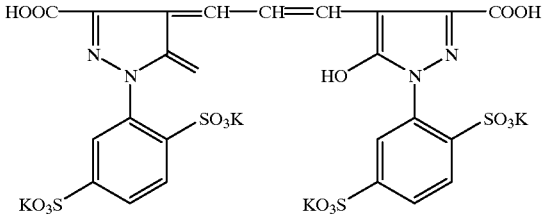

-continued

AI-2

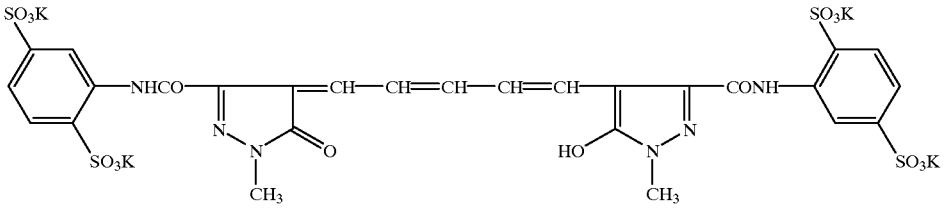

AI-3

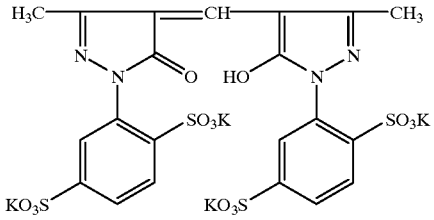

AI-4

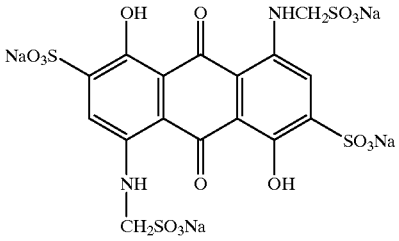

DI-1 (The mixture of the following compositions)

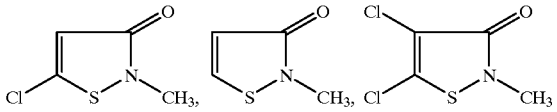

(A) (B) (C)

A:B:C = 50:46:4 (Molar ratio in the mixture)

BS-1

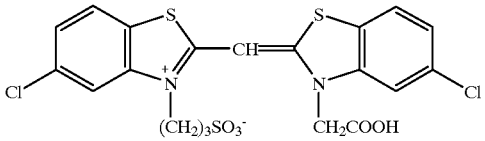

GS-1

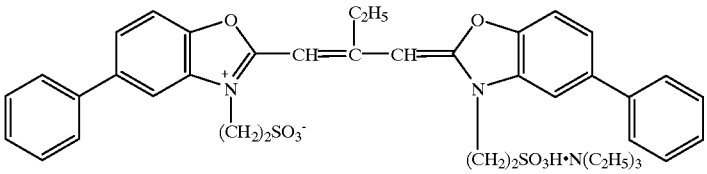

RS-1

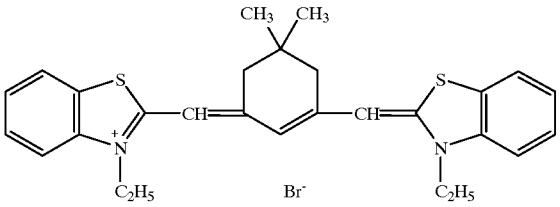

Comparative Samples 102 to 106 and Samples 107 to 112 according to the invention were prepared in the same manner as in Sample 101 except that the yellow coupler was replaced by the couplers shown in Table 1. The amount of the yellow coupler was adjusted so that the amount is the same as that in sample 101 in terms of mole.

The samples were each exposed to white light for 0.2 seconds through an optical wedge and color developed according to the following processing procedure. The maximum color density $D_{max}$ and the minimum color density $D_{min}$ of the processed samples were measured by an optical densitometer PDA-65 manufactured by Konica Corp.

The processed samples were exposed to sun light for 4 weeks and the remained density at the portion at which the initial density was 1.0 was measured for evaluating the light-fastness of the color image. The results of the test are shown in Table 1.

Processing conditions were as follows.

| Processing | Temperature | Time |
|---|---|---|
| Color development | 35.0 ± 0.3° C. | 45 seconds |
| Bleach-fixing | 35.0 ± 0.5° C. | 45 seconds |
| Stabilizing | 30 to 34° C. | 90 seconds |
| Drying | 60 to 80° C. | 60 seconds |

Developing solution

| | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-disulfonic acid | 1.0 g |
| Ethylenediaminetetraacetic acid | 1.0 g |
| Disodium catechol-3,5-disulfonate | 1.0 g |
| Ethylene glycol | 10 g |
| N-ethyl-N-β-methanesulfonamidoethyl- | 4.5 g |

-continued

| | |
|---|---|
| 3-methyl-4-aminoaniline sulfonate | |
| Fluorescent whitening agent (4,4'-diamino-stilbenesulfonic acid derivative) | 1.0 g |
| Potassium carbonate | 27 g |
| Water to make | 1 l |
| Adjust pH to 10.10 | |
| Bleach-fixing solution | |
| Ferric ammonium ethylenediaminetetraacetate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |
| Water to make | 1 l |
| Adjust pH to 5.7 using potassium carbonate of glacial acetic acid | |
| Stabilizing solution | |
| 5-chloro-2-methyl-4-isothiazoline-3-one | 0.2 g |
| 1,2-benzisothiazoline-3-one | 0.3 g |
| Ethylene glycol | 1.0 g |
| 1-hydroxyethylidene-1,1-disulfonic acid | 2.0 g |
| Sodium o-phenylphenol | 1.0 g |
| Ethylenediaminetetraacetic acid | 1.0 g |
| Ammonium hydroxide (20% aqueous solution) | 3.0 g |
| Fluorescent whitening agent (4,4'-diamino-stilbenesulfonic acid derivative) | 1.5 g |
| Water to make | 1 l |

Adjust pH to 7.0 using sulfuric acid or potassium hydroxide.

TABLE 1

| Sample No. | Yellow coupler | Turbidity of coupler dispersion (A) | Turbidity of coupler dispersion (B) | D max | D min | Light fastness |
|---|---|---|---|---|---|---|
| 101(Comp.) | Y-1 | 20 | 22 | 2.24 | 0.13 | 0.80 |
| 102(Comp.) | Y-2 | 18 | 205 | 2.27 | 0.14 | 0.62 |
| 103(Comp.) | Y-3 | 19 | 201 | 2.26 | 0.14 | 0.63 |
| 104(Comp.) | Y-4 | 20 | 23 | 2.23 | 0.13 | 0.68 |
| 105(Comp.) | Y-5 | 20 | 59 | 2.30 | 0.14 | 0.57 |
| 106(Comp.) | Y-6 | 18 | 50 | 2.26 | 0.14 | 0.61 |
| 107(Inv.) | (1) | 20 | 21 | 2.28 | 0.13 | 0.81 |
| 108(Inv.) | (4) | 19 | 21 | 2.30 | 0.13 | 0.82 |
| 109(Inv.) | (5) | 20 | 22 | 2.27 | 0.13 | 0.80 |
| 110(Inv.) | (7) | 18 | 19 | 2.32 | 0.13 | 0.81 |
| 111(Inv.) | (8) | 19 | 21 | 2.27 | 0.13 | 0.79 |
| 112(Inv.) | (15) | 20 | 21 | 2.30 | 0.13 | 0.81 |

Comp.: Comparison, Inv.: Invention

Y-1 (Comparative coupler)

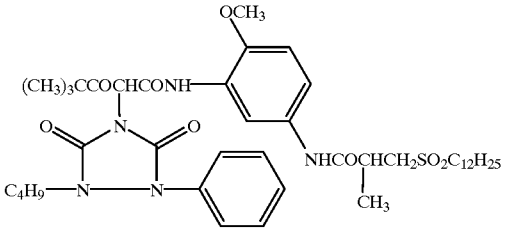

Y-2 (Comparative coupler)

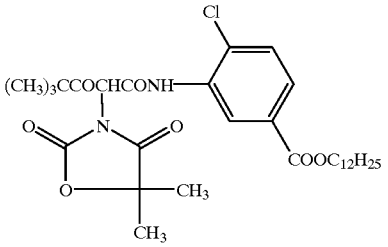

Y-3 (Comparative coupler)

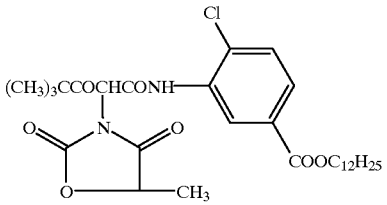

Y-4 (Comparative coupler)

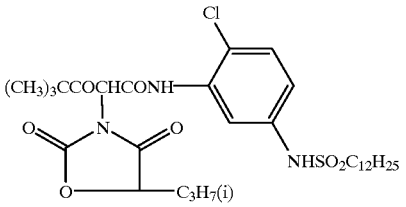

A compound described in Japanese Patent O.P.I. Publication No.11529/1977

Y-5 (Comparative coupler)

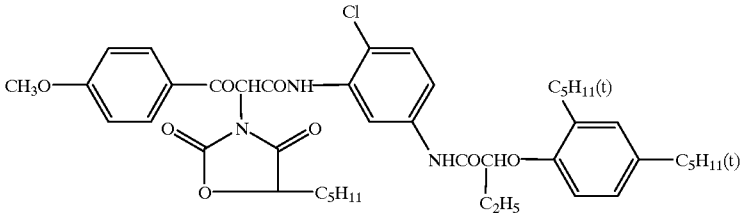

A compound described in Japanese Patent O.P.I. Publication No.11529/1977

-continued

Y-6 (Comparative coupler)

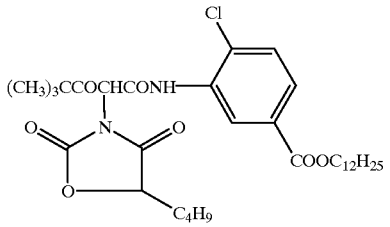

A compound described in U.S. Pat. No. 5,451,492

As can be seen from the results shown in Table 1, the samples each using the yellow coupler of the invention, are higher in the maximum density compared with the comparative samples each using the comparative coupler, Y-1 and Y-4, and more excellent in the dispersion stability compared with the comparative samples each using the comparative coupler, Y-2, Y-3, Y-5 and Y-6. The samples each using the yellow coupler of the invention, (4), (7) and (15) are especially excellent in the maximum density.

Example 2

A surface of a triacetyl cellulose film support was subjected to a subbing treatment, and layers each having the following constitution were provided in this order from the support on the subbed surface (surface) and another surface (back surface) of the support. In the following, the amount of ingredients are described in grams per square meter except an amount with a particular description. The amount of silver halide and colloidal silver are described in terms of silver.

First backing layer

| | |
|---|---|
| Alumina sol AS-100 (Aluminum oxide manufactured by Nissan Kagaku Kogyo Co.) | 100 mg |
| Diacetyl cellulose | 200 mg |

Second backing layer

| | |
|---|---|
| Diacetyl cellulose | 100 mg |
| Stearic acid | 10 mg |
| Fine particle of silica (Average particle size: 0.2 $\mu$m) | 50 mg |

The following layers provided on the subbed surface of the triacetyl cellulose film support in this order from the support to prepare Sample 201 of multi-layered color photographic light-sensitive material.

First layer: Antihalation layer HC

| | |
|---|---|
| Black colloidal silver | 0.15 g |
| UV absorbent (UV-4) | 0.20 g |
| Colored cyan coupler (CC-1) | 0.02 g |
| High-boiling solvent (Oil-1) | 0.20 g |
| High-boiling solvent (Oil-2) | 0.20 g |
| Gelatin | 1.6 g |

Second layer: Interlayer (IL-1)

| | |
|---|---|
| Gelatin | 1.3 g |

Third layer: Low speed red-sensitive emulsion layer (R-L)

| | |
|---|---|
| Silver iodobromide emulsion (Average grain size: 0.3 $\mu$m, average iodide content: 2.0 mole-%) | 0.4 g |
| Silver iodobromide emulsion (Average grain size: 0.4 $\mu$m, average iodide content: 8.0 mole-%) | 0.3 g |
| Sensitizing dye (S-1) | $3.2 \times 10^{-4}$ moles/mole of silver |
| Sensitizing dye (S-2) | $3.2 \times 10^{-4}$ moles/mole of silver |
| Sensitizing dye (S-3) | $0.2 \times 10^{-4}$ moles/mole of silver |
| Cyan coupler (C-3) | 0.50 g |
| Cyan coupler (C-4) | 0.13 g |

-continued

| | |
|---|---|
| Colored cyan coupler (CC-1) | 0.07 g |
| DIR compound (D-1) | 0.006 g |
| DIR compound (D-2) | 0.01 g |
| High-boiling solvent (Oil-1) | 0.55 g |
| Gelatin | 1.0 g |

Fourth layer: High speed red-sensitive emulsion layer (R-H)

| | |
|---|---|
| Silver iodobromide emulsion (Average grain size: 0.7 $\mu$m, average iodide content: 7.5 mole-%) | 0.9 g |
| Sensitizing dye (S-1) | $1.7 \times 10^{-4}$ moles/mole of silver |
| Sensitizing dye (S-2) | $1.6 \times 10^{-4}$ moles/mole of silver |
| Sensitizing dye (S-3) | $0.1 \times 10^{-4}$ moles/mole of silver |
| Cyan coupler (C-4) | 0.23 g |
| Colored cyan coupler (CC-1) | 0.03 g |
| DIR compound (D-2) | 0.02 g |
| High-boiling solvent (Oil-1) | 0.25 g |
| Gelatin | 1.0 g |

Fifth layer: Interlayer (IL-2)

| | |
|---|---|
| Gelatin | 0.8 g |

Sixth layer: Low speed green-sensitive emulsion layer (G-L)

| | |
|---|---|
| Silver iodobromide emulsion (Average grain size: 0.4 $\mu$m, average iodide content: 8.0 mole-%) | 0.6 g |
| Silver iodobromide emulsion (Average grain size: 0.3 $\mu$m, average iodide content: 2.0 mole-%) | 0.2 g |
| Sensitizing dye (S-4) | $6.7 \times 10^{-4}$ moles/mole of silver |
| Sensitizing dye (S-5) | $0.8 \times 10^{-4}$ moles/mole of silver |
| Magenta coupler (M-2) | 0.17 g |
| Magenta coupler (M-3) | 0.43 g |
| Colored magenta coupler (CM-1) | 0.10 g |
| DIR compound (D-3) | 0.02 g |
| High-boiling solvent (Oil-2) | 0.7 g |
| Gelatin | 1.0 g |

Seventh layer: High speed green-sensitive emulsion layer (G-H)

| | |
|---|---|
| Silver iodobromide emulsion (Average grain size: 0.7 $\mu$m, average iodide content: 7.5 mole-%) | 0.9 g |
| Sensitizing dye (S-6) | $1.1 \times 10^{-4}$ moles/mole of silver |
| Sensitizing dye (S-7) | $2.0 \times 10^{-4}$ moles/mole of silver |
| Sensitizing dye (S-8) | $0.3 \times 10^{-4}$ moles/mole of silver |
| Magenta coupler (M-2) | 0.30 g |
| Magenta coupler (M-3) | 0.13 g |
| Colored magenta coupler (CM-1) | 0.04 g |
| DIR compound (D-3) | 0.004 g |
| High-boiling solvent (Oil-2) | 0.35 g |
| Gelatin | 1.0 g |

Eighth layer: Yellow filter layer (YC)

| | |
|---|---|
| Yellow colloidal silver | 0.1 g |
| Additive (HS-1) | 0.07 g |
| Additive (HS-2) | 0.07 g |
| Additive (SC-1) | 0.12 g |
| High-boiling solvent (Oil-2) | 0.15 g |
| Gelatin | 1.0 g |

Ninth layer: Low speed blue-sensitive emulsion layer (B-L)

| | |
|---|---|
| Silver iodobromide emulsion (Average grain size: 0.3 $\mu$m, average iodide content: 2.0 mole-%) | 0.25 g |
| Silver iodobromide emulsion (Average grain size: 0.4 $\mu$m, average iodide content: 8.0 mole-%) | 0.25 g |
| Sensitizing dye (S-9) | $5.8 \times 10^{-4}$ moles/mole of silver |

-continued

| | |
|---|---|
| Yellow coupler (Y-7) | 0.95 g |
| DIR compound (D-1) | 0.003 g |
| DIR compound (D-2) | 0.006 g |
| High-boiling solvent (Oil-2) | 0.18 g |
| Gelatin | 1.3 g |
| Tenth layer: High speed blue-sensitive emulsion layer (B-H) | |
| Silver iodobromide emulsion (Average grain size: 0.8 μm, average iodide content: 8.5 mole-%) | 0.5 g |
| Sensitizing dye (S-10) | $3 \times 10^{-4}$ moles/mole of silver |
| Sensitizing dye (S-11) | $1.2 \times 10^{-4}$ moles/mole of silver |
| Yellow coupler (Y-7) | 0.20 g |
| High-boiling solvent (Oil-2) | 0.05 g |
| Gelatin | 1.0 g |
| Eleventh layer: First protective layer PRO-1 | |
| Silver iodobromide (Average size: 0.08 μm) | 0.3 g |
| UV absorbent (UV-4) | 0.07 g |
| UV absorbent (UV-5) | 0.10 g |
| Additive (HS-1) | 0.2 g |
| Additive (HS-2) | 0.1 g |
| High-boiling solvent (Oil-1) | 0.07 g |
| High-boiling solvent (Oil-3) | 0.07 g |
| Gelatin | 0.8 g |
| Twelfth layer: Second protective layer PRO-2 | |
| Lubricant (WAX-1) | 0.04 g |
| Surfactant (SU-4) | 0.004 g |
| Polymethyl methacrylate (Average particle size: 3 μm) | 0.02 g |

-continued

| | |
|---|---|
| Copolymer of methyl methacrylate, ethyl methacrylate and methacrylic acid in a weight ratio of 3:3:4 (Average particle size: 3 μm) | 0.13 g |

The silver halide emulsions used in the sample were each a core/shell type monodisperse emulsion having a size distribution width of not more than 20%. The emulsion were each subjected to an optimal chemical sensitization in the presence of sodium thiosulfate, chloroauric acid and ammonium thiocyanate, and the sensitizing dyes, the stabilizer (STAB-1) and the antifoggant (AF-1) were added to the emulsion.

AF-1: 1-phenyl-5-mercaptotetrazole

Oil-1: Dioctyl phthalate (=DOP)

Oil-2: Tricresylphosphate

Oil-3: Dibutyl phthalate (=DBP)

HS-1: Hydantoin

HS-2: 4-ureidohydatoin

SU-4: Sodium di(2.2.3.3.4.4.5.5.6.6.7.7-dodecylfluoropentyl)sulfosuccinate

C-3

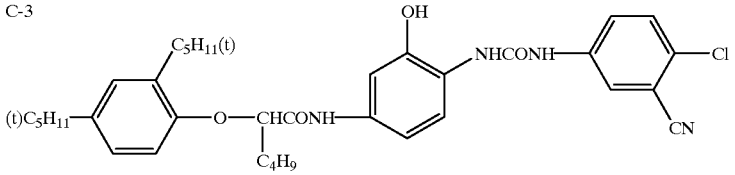

C-4

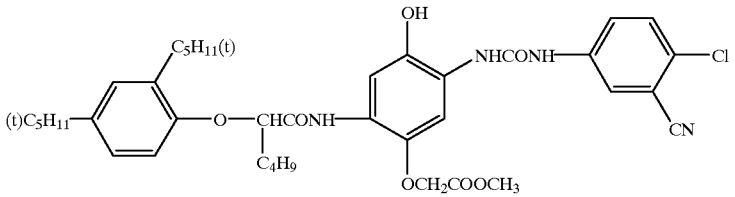

M-2

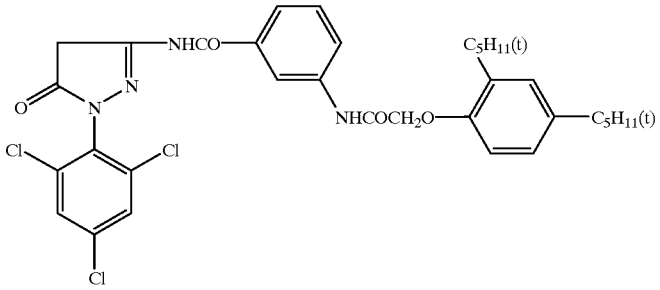

-continued
M-3
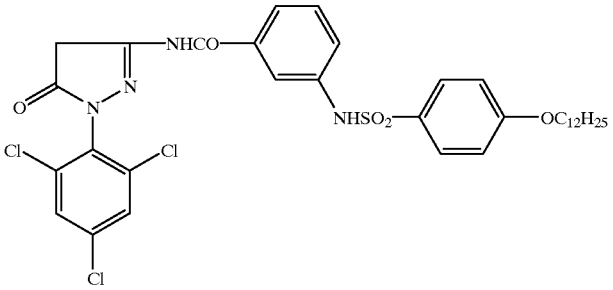
Y-7
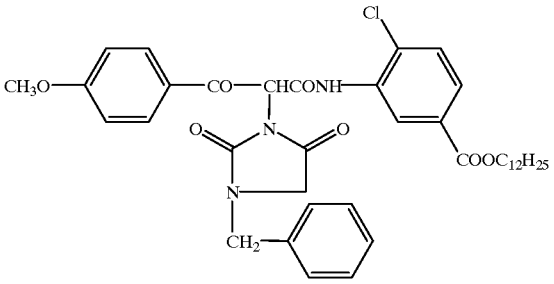
CC-1
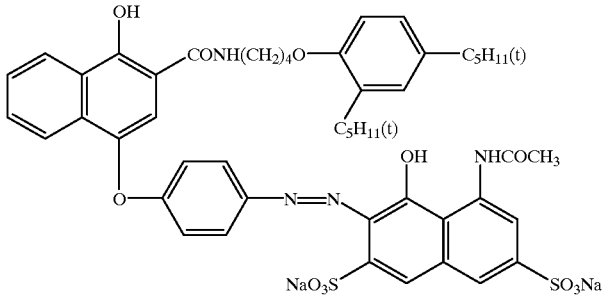
CM-1
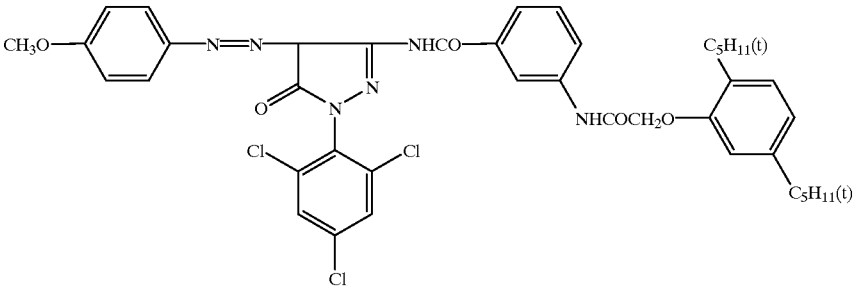

-continued
D-1
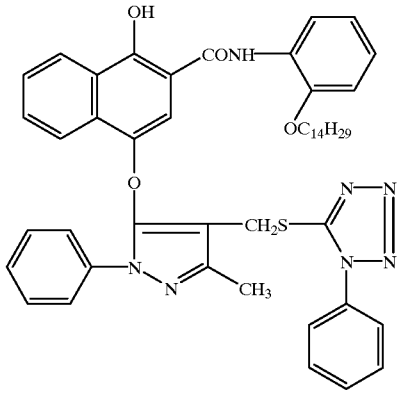
D-2
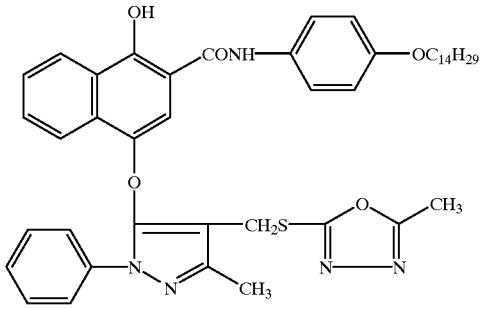
D-3
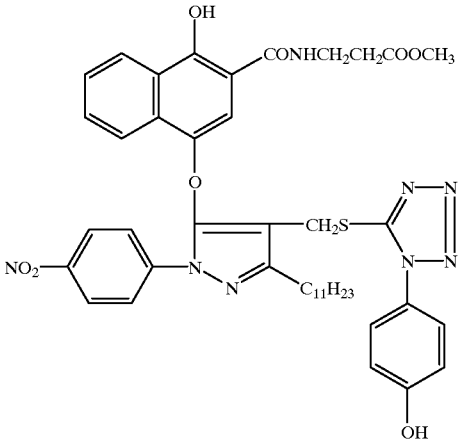
UV-4
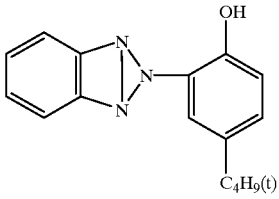
UV-5
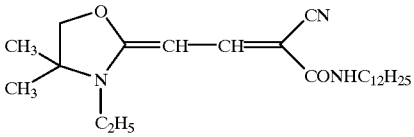

-continued
S-1
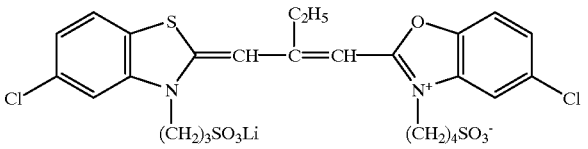
S-2
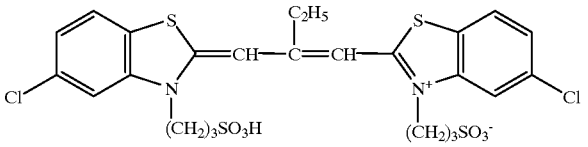
S-3
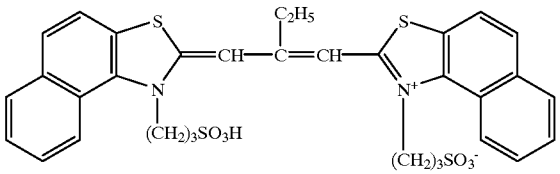
S-4
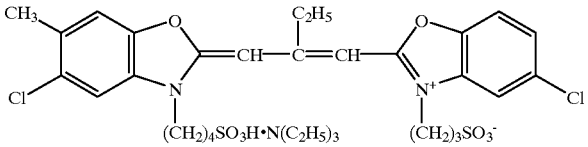
S-5
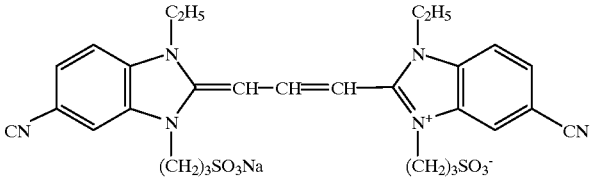
S-6
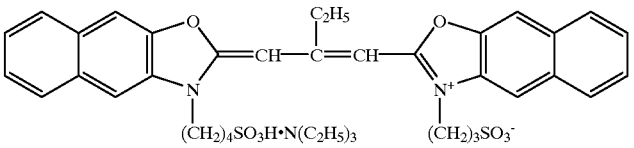
S-7
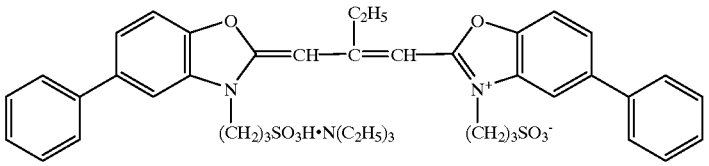
S-8
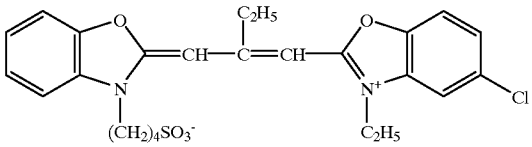
S-9
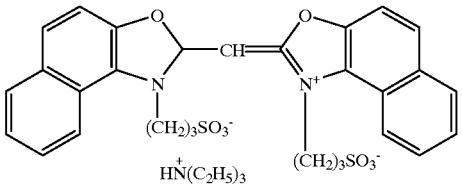

-continued

S-10

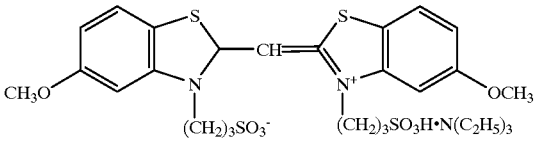

S-11

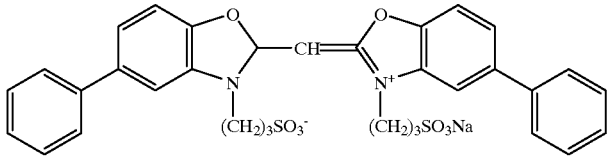

SC-1

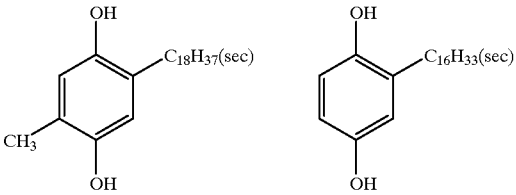

(A mixture of 2:3)

WAX-1

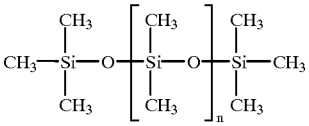

Weight average molecular weight MW:3,000

The above-mentioned Sample 201 further contained S-surfactants SU-1 and SU-5, viscosity adjusting agent, hardeners H-1 and H-2, stabilizer STAB-1, antifoggant AF-1 and AF-2 containing one having a weight average molecular weight of 10,000 of polyvinylpyrrolidone and one having a weight average molecular weight of 1,100,000 of polyvinylpyrrolidone, antiirradiation dyes AI-5 and AI-6, and 9.4 mg/$M^2$ of antifungal agent DI-1.

SU-5: Sodium dioctylsulfosuccinate

AI-5

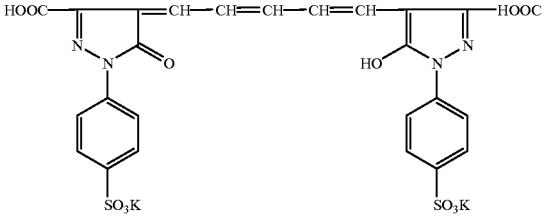

AI-6

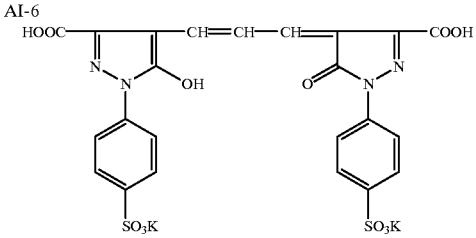

Samples 202 to 207 were prepared in the same manner as in Sample 201 except that yellow coupler Y-7 contained in the ninth and tenth layers was replaced by equal moles of the yellow coupler shown in Table 2.

The samples 201 to 207 were each exposed to white light through an optical wedge for 1/100 seconds and processed according to the following processing procedure. The maximum color density and the minimum color density of each of the processed samples were measured by an optical densitometer PDA-65, manufactured by Konica Corporation. Thus obtained results are shown in Table 2.

Processing samples was carried out as follows.

Processing procedure

| Processing | Time | Temperature | Replenishing amount |
|---|---|---|---|
| Color developing | 3 min. 15 sec. | 38 ± 0.3° C. | 780 ml/$m^2$ |
| Bleaching | 45 sec. | 38 ± 2.0° C. | 150 ml/$m^2$ |
| Fixing | 1 min. 30 sec. | 38 ± 2.0° C. | 830 ml/$m^2$ |
| Stabilizing | 60 sec. | 38 ± 5.0° C. | 830 ml/$m^2$ |
| Drying | 1 min. | 55 ± 5.0° C. | — |

The following color developer, bleaching solution, stabilizer, and replenisher for them were used.

Color developer

| | |
|---|---|
| Water | 800 ml |
| Potassium carbonate | 30 g |
| Sodium hydrogen carbonate | 2.5 g |
| Potassium sulfite | 3.0 g |

-continued

| | |
|---|---|
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxyethyl)aniline sulfate | 4.5 g |
| Diethylenetriaminepentaacetic acid | 3.0 g |
| Potassium hydroxide | 1.2 g |
| Water to make | 1 l |
| Adjust pH to 10.06 by potassium hydroxide or 20% sulfuric acid. | |

Color developer replenisher

| | |
|---|---|
| Water | 800 ml |
| Potassium carbonate | 35 g |
| Sodium hydrogen carbonate | 3 g |
| Potassium sulfite | 5 g |
| Sodium bromide | 0.4 g |
| Hydroxylamine sulfate | 3.1 g |
| 4-amino-3-methyl-N-ethyl-N-(β-hydroxyethyl)aniline sulfate | 6.3 g |
| Diethylenetriaminepentaacetic acid | 3.0 g |
| Potassium hydroxide | 2 g |
| Water to make | 1 l |
| Adjust pH to 10.18 by potassium hydroxide or 20% sulfuric acid. | |

Bleaching solution

| | |
|---|---|
| Water | 700 ml |
| Ferric ammonium 1,3-diaminopropanetetraacetate | 125 g |
| Ethylenediaminetetraacetic acid | 2 g |
| Sodium nitrate | 40 g |
| Ammonium bromide | 150 g |
| Glacial acetic acid | 40 g |
| Water to make | 1 l |
| Adjust pH to 4.4 by ammonia water of glacial acetic acid. | |

Bleaching solution replenisher

| | |
|---|---|
| Water | 700 ml |
| Ferric ammonium 1,3-diaminopropanetetraacetate | 175 g |
| Ethylenediaminetetraacetic acid | 2 g |
| Sodium nitrate | 50 g |
| Ammonium bromide | 200 g |
| Glacial acetic acid | 56 g |
| Water to make 1 l after adjusting pH to 4.0 by ammonia water or glacial acetic acid. | |

Fixer

| | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |
| Water to make 1 l after adjusting pH to 6.2 by ammonia water or glacial acetic acid | |

Fixer replenisher

| | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |
| Water to make 1 l after adjusting pH to 6.5 by ammonia water or glacial acetic acid. | |

Stabilizer and stabilizer replenisher

| | |
|---|---|
| Water | 900 ml |
| p-octylphenoloxy-deca(ethyleneoxy)hydrogen | 2.0 g |
| Dimethylolurea | 0.5 g |
| Hexamethylenetetramine | 0.2 g |
| 1,2-benziosthiazoline-3-one | 0.1 g |
| Siloxane (L-77, manufactured by UCC) | 0.1 g |
| Ammonia water | 0.5 ml |
| Water to make | 1 l |
| Adjust pH to 8.5 by ammonia water or 50% sulfuric acid. | |

TABLE 2

| Sample No. | Yellow coupler | D max | D min |
|---|---|---|---|
| 201 (Comp.) | Y-7 | 3.00 | 0.64 |
| 202 (Inv.) | (1) | 3.06 | 0.62 |
| 203 (Inv.) | (7) | 3.08 | 0.61 |
| 204 (Inv.) | (12) | 3.09 | 0.61 |
| 205 (Inv.) | (15) | 3.12 | 0.60 |
| 206 (Inv.) | (18) | 3.09 | 0.63 |
| 207 (Inv.) | (20) | 3.08 | 0.63 |

Comp.: Comparision, Inv.: Invention

The results in Table 2 show that the samples using the couplers according to the invention are higher in the maximum density and lower in the fog compared with the comparative samples.

Example 3

A surface of a triacetyl cellulose film support was subjected to a subbing treatment, and layers each having the following composition were provided in this order from the support on the subbed surface and another surface or back surface of the support. In the followings, the amount of ingredients are described in grams per square meter except an amount with a particular description. The amount of silver halide and colloidal silver are described in terms of silver.

| | |
|---|---|
| First backing layer | |
| Alumina sol AS-100 (Aluminum oxide manufactured by Nissan Kagaku Kogyo Co.). | 0.8 g |
| Second backing layer | |
| Diacetyl cellulose | 100 mg |
| Stearic acid | 10 mg |
| Fine particle of silica (Average particle size: 0.2 μm) | 50 mg |

On the subbed surface of the triacetyl cellulose film support, layers each having the following composition were provided in this order from the support to prepare a multi-layered color light-sensitive material sample 301.

| | |
|---|---|
| First layer (Antihalation layer) | |
| Black colloidal silver | 0.24 g |
| UV absorbent (U-1) | 0.14 g |
| UV absorbent (U-2) | 0.072 g |
| UV absorbent (U-3) | 0.072 g |
| UV absorbent (U-4) | 0.072 g |
| High-boiling solvent (O-1) | 0.31 g |
| High-boiling solvent (O-2) | 0.098 g |
| Poly-N-vinylpyrrolidone | 0.15 g |
| Gelatin | 2.02 g |
| Second layer (Interlayer) | |
| High-boiling solvent (O-3) | 0.011 g |
| Gelatin | 1.17 g |
| Third layer (Low speed red-sensitive layer) | |
| Silver iodobromide emulsion spectrally sensitized by red-sensitizing dyes S-12 and S-13 (AgI: 3.0 mole-%, Average size: 0.30 μm) | 0.60 g |
| Cyan coupler (C-5) | 0.37 g |
| High-boiling solvent (O-2) | 0.093 g |
| Poly-N-vinylpyrrolidone | 0.074 g |

-continued

| | |
|---|---|
| Gelatin | 1.35 g |
| Fourth layer (High speed red-sensitive layer) | |
| Silver iodobromide emulsion spectrally sensitized by red-sensitizing dyes S-12 and S-13 (AgI: 3.0 mole-%, Average size: 0.80 μm) | 0.60 g |
| Cyan coupler (C-5) | 0.85 g |
| High-boiling solvent (O-2) | 0.21 g |
| Poly-N-vinylpyrrolidone | 0.093 g |
| Gelatin | 1.56 g |
| Fifth layer (Interlayer) | |
| Color mixing preventing agent (SC-1) | 0.20 g |
| High-boiling solvent (O-3) | 0.25 g |
| Matting agent (MA-1) | 0.0091 g |
| Gelatin | 1.35 g |
| Sixth layer (Low speed green-sensitive layer) | |
| Silver iodobromide emulsion spectrally sensitized by green-sensitizing dye S-14 (AgI: 3.0 mole-%, Average size: 0.30 μm) | 0.70 g |
| Maganta coupler (M-4) | 0.31 g |
| Maganta coupler (M-5) | 0.076 g |
| High-boiling solvent (O-3) | 0.059 g |
| Poly-N-vinylpyrrolidone | 0.074 g |
| Gelatin | 1.29 g |
| Seventh layer (High speed green-sensitive layer) | |
| Silver iodobromide emulsion spectrally sensitized by green-sensitizing dye S-14 (AgI: 3.0 mole-%, Average size: 0.30 μm) | 0.70 g |
| Maganta coupler (M-4) | 0.80 g |
| Maganta coupler (M-5) | 0.19 g |
| Color mixing preventing agent (SC-1) | 0.055 g |
| High-boiling solvent (O-3) | 0.16 g |
| Poly-N-vinylpyrrolidone | 0.12 g |
| Gelatin | 1.91 g |
| Eighth layer (Inter layer) | |
| Gelatin | 0.90 g |
| Ninth layer (Yellow filter layer) | |
| Yellow colloidal silver | 0.11 g |
| Color mixing preventing agent (SC-1) | 0.068 g |
| High-boiling solvent (O-3) | 0.085 g |
| Matting agent (MA-1) | 0.012 g |
| Gelatin | 0.68 g |
| Tenth layer (Low speed blue-sensitive layer) | |
| Silver iodobromide emulsion spectrally sensitized by blue-sensitizing dye S-15 (AgI: 3.0 mole-%, Average size: 0.30 μm) | 0.70 g |
| Yellow coupler (Y-8) | 0.86 g |
| Image stabilizing agent (G-1) | 0.012 g |
| High boiling solvent (O-3) | 0.22 g |
| Poly-N-vinylpyrrolidone | 0.078 g |
| Compound (HS-1) | 0.040 g |
| Compound (HS-2) | 0.020 g |
| Gelatin | 1.09 g |
| Eleventh layer (High speed blue-sensitive layer) | |
| Silver iodobromide emulsion spectrally sensitized by blue-sensitizing dye S-15 (AgI: 3.0 mole-%, Average size: 0.85 μm) | 0.70 g |
| Yellow couplet (Y-8) | 1.24 g |
| Image stabilizing agent (G-1) | 0.017 g |

-continued

| | |
|---|---|
| High-boiling solvent (O-3) | 0.31 g |
| Poly-N-vinylpyrrolidone | 0.10 g |
| Compound (HS-1) | 0.077 g |
| Compound (HS-2) | 0.039 g |
| Gelatin | 1.73 g |
| Twelfth layer (Protective layer-1) | |
| Non-light-sensitive silver iodobromide fine grains (AgI: 1.0 mole-%, average size: 0.08 μm) | 0.075 g |
| UV absorbent (U-1) | 0.048 g |
| UV absorbent (U-2) | 0.024 g |
| UV absorbent (U-3) | 0.024 g |
| UV absorbent (U-4) | 0.024 g |
| High-boiling solvent (O-1) | 0.13 g |
| High-boiling solvent (O-2) | 0.13 g |
| Compound (HS-1) | 0.15 g |
| Compound (HS-2) | 0.075 g |
| Gelatin | 1.2 g |
| Thirteenth layer (Protective layer-2) | |
| Lubricant (WAX-1) | 0.041 g |
| Matting agent (MA-2) | 0.0090 g |
| Matting agent (MA-3) | 0.051 g |
| Surfactant (SU-4) | 0.0036 g |
| Gelatin | 0.55 g |

(The poly-N-vinylprrolidone used in the layers was one having a weight average molecular weight of 350,00.)

In the light-sensitive material sample 301, gelatin hardeners H-1, H-2 and H-3, water-soluble dyes AI-5, AI-6 and AI-7, antifungal agent DI-1, stabilizing agent STAB-1 and antifoggant AF-1 were optionally added as required.

The silver halide emulsions used in the light-sensitive layers were each a monodisperse emulsion having a grain size distribution width of not more than 20%. Each of ht emulsions was subjected to an optimal chemical ripening in the presence of sodium thiosulfate, chloroaquric acid and ammonium thiocyanate after desalted by washing. The sensitizing dye for spectrally sensitizing the emulsion, STAB-1 and AF-1 were added to each the emulsion.

The with of the grain size distribution is defined by the following equation.

Grain size distribution width (%)=Standard deviation of grain size/Average grain size×100

MA-1: Colloidal silica particles (Average size: 3.5 μm)
MA-2: Polymethyl methacrylate particles (Average size: 3.0 μm
O-1: Di-2-ethylhexylphthalate
O-2: Dibutylphthalate (=Oil-3)
O-3: Tricresylphosphate (=Oil-2)
G-1: Dodecyl gallate
H-3: $[(Ch_2{=}CHSO_2CH_2)_3CCH_2SO_2CH_2CH_2]_2NCH_2CH_2SO_3K$ S-12
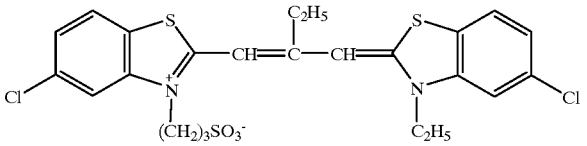
S-13
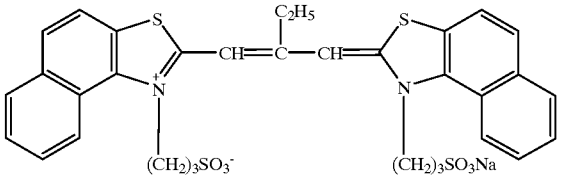
S-14
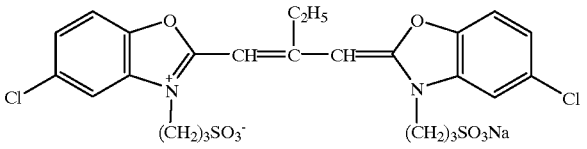
S-15
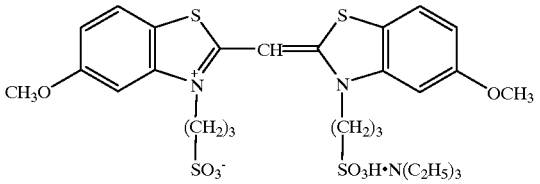
C-5
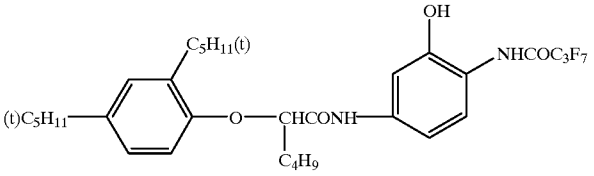
M-4
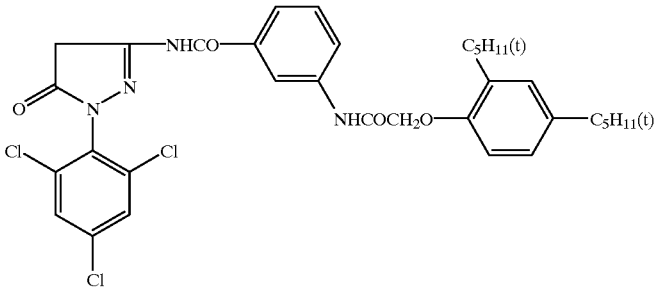
M-5
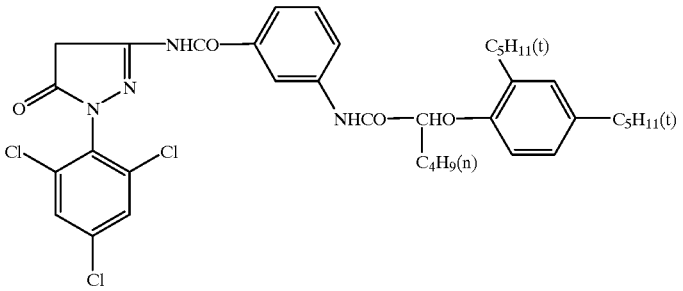

-continued

Y-8

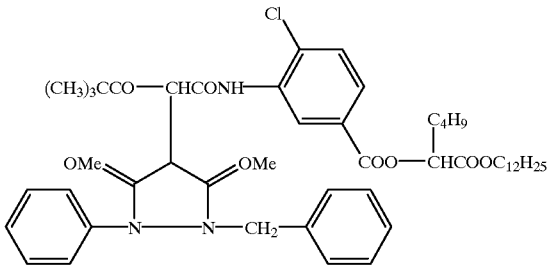

MA-3

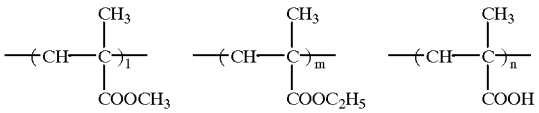

(l:m:n = 30:30:40) (weight ratio)

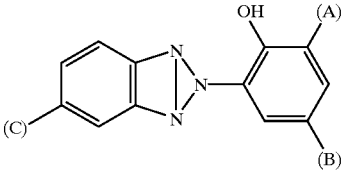

| | A | B | C | |
|---|---|---|---|---|
| U-1 | H | $C_4H_9(t)$ | H | (=UV-4) |
| U-2 | $C_4H_9(t)$ | $C_4H_9(t)$ | H | (=UV-2) |
| U-3 | $C_4H_9(t)$ | $CH_3$ | Cl | |
| U-4 | $C_4H_9(t)$ | $C_4H_9(t)$ | Cl | |

AI-7

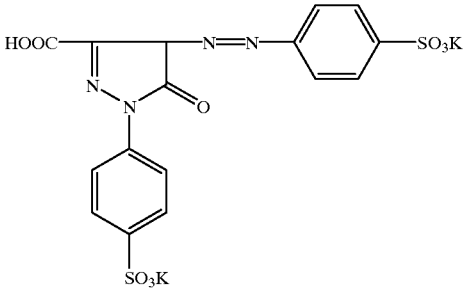

Samples 302 and 303 according to the invention were prepared in the same manner as in Sample 301 except that the yellow coupler in the tenth and eleventh layer was replaced by the coupler shown in Table 3. The amount of the coupler was controlled so that the amount in mole was the same as the amount of the coupler in sample 301.

The samples were each exposed to white light through an optical wedge for 1/100 seconds and processed according to the following processing procedure. The maximum color density and the minimum color density of each of the processed samples were measured by an optical densitometer PDA-65, manufactured by Konica Corporation.

As a result, it was found that the inventive samples using the coupler according to the invention formed images each having a higher color maximum density and lower fog density compared with the comparative sample.

TABLE 3

| Sample No. | Yellow coupler |
|---|---|
| 301 (Comp.) | Y-8 |
| 302 (Inv.) | (3) |
| 303 (Inv.) | (17) |

Comp.: Comparision, Inv.: Invention

| Process | Time | Temperature |
|---|---|---|
| First developing | 6 minutes | 38° C. |
| Washing | 2 minutes | 38° C. |
| Reversing | 2 minutes | 38° C. |
| Color developing | 6 minutes | 38° C. |
| Modulating | 2 minutes | 38° C. |
| Bleaching | 6 minutes | 38° C. |
| Fixing | 4 minutes | 38° C. |

-continued

| Process | Time | Temperature |
|---|---|---|
| Washing | 4 minutes | 38° C. |
| Stabilizing | 1 minute | Ordinary temperature |
| Drying | | |

The processing solutions used in the above-mentioned processing were as follows.

| | |
|---|---|
| First developer | |
| Sodium tetrapolyphosphate | 2 g |
| Sodium sulfite | 20 g |
| Hydroquinone monosulfonate | 30 g |
| Sodium carbonate monohydrate | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1000 ml |
| Adjust pH to 9.60. | |
| Reversing solution | |
| Hexasodium nitrilotrimethylenesulfonate | 3 g |
| Stanneous chloride dehydrate | 1 g |
| p-aminophenol | 0.1 g |
| Sodium hydroxide | 8 g |
| Glacial acetic acid | 15 ml |
| Water to make | 1000 ml |
| Adjust pH to 5.75. | |
| Color developer | |
| Sodium tetrapolyphosphate | 3 g |
| Sodium sulfite | 7 g |
| Trisodium phosphate dihydrate | 36 g |
| Potassium bromide | 1 g |
| Potassium iodide (0.1% solution) | 90 ml |
| Sodium hydroxide | 3 g |
| Citragic acid | 1.5 g |
| N-ethyl-N-β-mehtanesulfonamidoethyl-3-methyl-4-aminoaniline sulfate | 11 g |
| 2,2-ethylenedithioethanol | 1 g |
| Water to make | 1000 ml |
| Adjust pH to 11.70. | |
| Modulating solution | |
| Sodium sulfite | 12 g |
| Sodium ethylenediaminetetraacetate dihydrate | 8 g |
| Thioglyceline | 0.4 ml |
| Glacial acetic acid | 3 ml |
| Water to make | 1000 ml |
| Adjust pH to 6.15. | |
| Bleaching solution | |
| Sodium ethylenediaminetetraacetate dihydrate | 2 g |
| Ferric (III) ammonium ethylenediamine-tetraacetate dihydrate | 120 g |
| Ammonium bromide | 100 g |
| Water to make | 1000 ml |
| Adjust pH to 5.65. | |
| Fixer | |
| Ammonium thiosulfate | 80 g |
| Sodium sulfite | 5 g |
| Sodium bisulfite | 5 g |
| Water to make | 1000 ml |
| Adjust pH to 6.60. | |
| Stabilizinq solution | |
| Formalin (37 weight-%) | 5 ml |
| Konidacks (Konica Corporation) | 5 ml |
| Water to make | 1000 ml |
| Adjust pH to 7.00. | |

What is claimed is:

1. A silver halide color photographic light-sensitive material comprising a support having thereon a silver halide emulsion layer containing silver halide grains, wherein said silver halide emulsion layer contains a yellow coupler represented by the following Formula [I];

Formula [I]

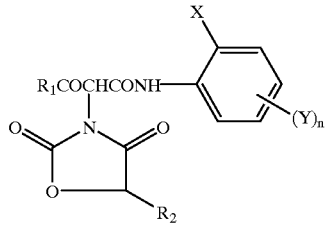

wherein $R_1$ represents an alkyl group, a cycloalkyl group, an amino group, a heterocyclic group or an aryl group, $R_2$ represents a straight chain or branched unsubstituted alkyl group having not less than 2 carbon atoms; X represents a chlorine atom, an alkoxy group or aryloxy group; Y represents an acylamino group or a chlorine atom when $R_1$ represents an alkyl group, a cycloalkyl group, an amino group or a heterocyclic group; and Y represents an sulfonylamino group, a chlorine atom or oxycarbonyl group when $R_1$ represents an aryl group; n represents an integer of 0 to 4; when n is not less than 2, plural Y may be either the same or different.

2. The silver halide color photographic light-sensitive material of claim 1, wherein $R_1$ represents an alkyl group, a cycloalkyl group, an amino group or a heterocyclic group.

3. The silver halide color photographic light-sensitive material of claim 1, wherein $R_1$ represents an aryl group.

4. The silver halide color photographic light-sensitive material of claim 2 wherein $R_1$ is an alkyl group.

5. The silver halide color photographic light-sensitive material of claim 1 wherein $R_1$ is a t-butyl group.

6. The silver halide color photographic light-sensitive material of claim 1 wherein $R_2$ is a straight chain unsubstituted alkyl group.

7. The silver halide color photographic light-sensitive material of claim 6 wherein $R_2$ has at least 4 carbon atoms.

8. The silver halide color photographic light-sensitive material of claim 5 wherein $R_2$ is a straight chain unsubstituted alkyl group.

9. The silver halide color photographic light-sensitive material of claim 8 wherein $R_2$ has at least 4 carbon atoms.

10. The silver halide color photographic light-sensitive material of claim 9 wherein Y is a chlorine atom.

11. The silver halide color photographic light-sensitive material of claim 9 wherein Y is an acylamino group.

12. The silver halide color photographic light-sensitive material of claim 11 wherein said acylamino group is a palmitoylamino group, a stearolylamino group, or a 2-(2,4-di-t-pentylphenoxy)butanoylamino group.

13. The silver halide color photographic light-sensitive material of claim 1 wherein at least one of $R_2$, X, and Y is a nondiffusable group.

14. The silver halide color photographic light-sensitive material of claim 10 wherein at least one of $R_2$, X, and Y is a nondiffusable group.

15. The silver halide color photographic light-sensitive material of claim 14 wherein X is an aryloxy group.

16. The silver halide color photographic light-sensitive material of claim 14 wherein X is an alkoxy group.

17. The silver halide color photographic light-sensitive material of claim 1 wherein a total of carbon atoms in $R_1$, X, and Y is at least 12.

18. The silver halide color photographic light-sensitive material of claim 16 wherein a total of carbon atoms in $R_1$, X, and Y is at least 12.

19. The silver halide color photographic light-sensitive material of claim 1 wherein the yellow coupler is added in an amount of $1\times10^{-3}$ moles to 1 mol per mol of silver halide.

20. The silver halide color photographic light-sensitive material of claim 9 wherein the yellow coupler is added in an amount of $1\times10^{-3}$ moles to 1 mol per mol of silver halide.

21. The silver halide color photographic light-sensitive material of claim 1 wherein the emulsion layer comprises an ultraviolet radiation absorber.

22. The silver halide color photographic light-sensitive material of claim 9 wherein the emulsion layer comprises an ultraviolet radiation absorber.

* * * * *